United States Patent [19]

Saint

[11] 4,022,510

[45] May 10, 1977

[54] SEAT FOR BABY SWING

[75] Inventor: David Saint, Elverson, Pa.

[73] Assignee: Graco Metal Products, Inc., Elverson, Pa.

[22] Filed: Nov. 5, 1975

[21] Appl. No.: 629,058

[52] U.S. Cl. ..... 297/153; 297/440

[51] Int. Cl.[2] ..... A47B 39/00

[58] Field of Search ..... 297/148, 273, 274, 307, 297/153, 309, 440, 441; 5/101, 102, 103, 104; 272/86, 87, 88, 89

[56] References Cited

UNITED STATES PATENTS

| | | | |
|---|---|---|---|
| 743,546 | 11/1903 | Nix | 297/273 X |
| 1,292,646 | 1/1919 | Reynolds | 297/153 |
| 2,317,243 | 4/1943 | Andergregg | 297/274 X |
| 2,963,761 | 12/1960 | Haydock | 297/153 X |
| 2,994,557 | 8/1961 | King | 297/153 X |
| 3,088,734 | 5/1963 | Grudoski | 272/85 |
| 3,256,016 | 1/1966 | Berlin | 272/85 |
| 3,459,423 | 8/1969 | Meade | 297/274 X |
| 3,761,969 | 10/1973 | Meade | 5/93 R |
| 3,794,317 | 2/1974 | Barrett | 297/274 |

*Primary Examiner*—James T. McCall
*Attorney, Agent, or Firm*—Z. T. Wobensmith, 2nd; Z. T. Wobensmith, III

[57] ABSTRACT

A seat construction for a baby swing is disclosed having a flexible fabric seat and back supported by a wire frame, a molded synthetic plastic tray being provided in front of the flexible seat and which has the wire frame engaged therewith, the frame and tray being constructed to facilitate assembly and folding for storage, the seat construction being supported from a swing frame by rods at the front extending through the tray and engaged with the frame and at the back by hooked supports engaging the frame at upper corners thereof.

6 Claims, 10 Drawing Figures

Fig. 1.
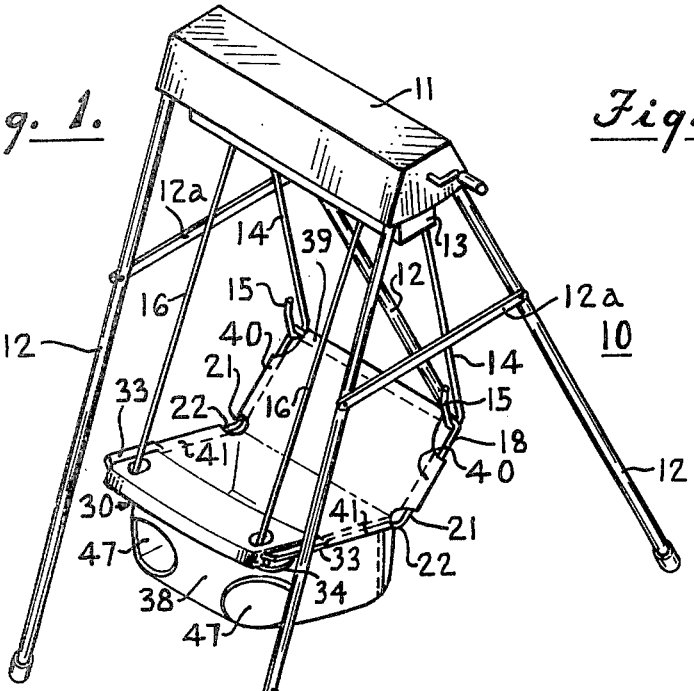
Fig. 1A
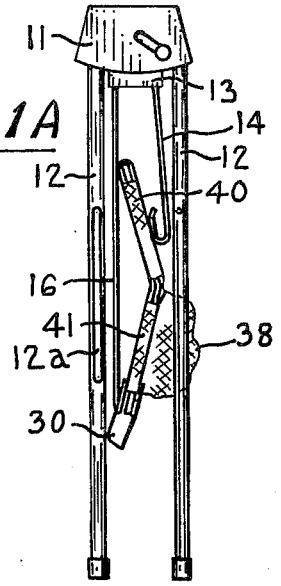
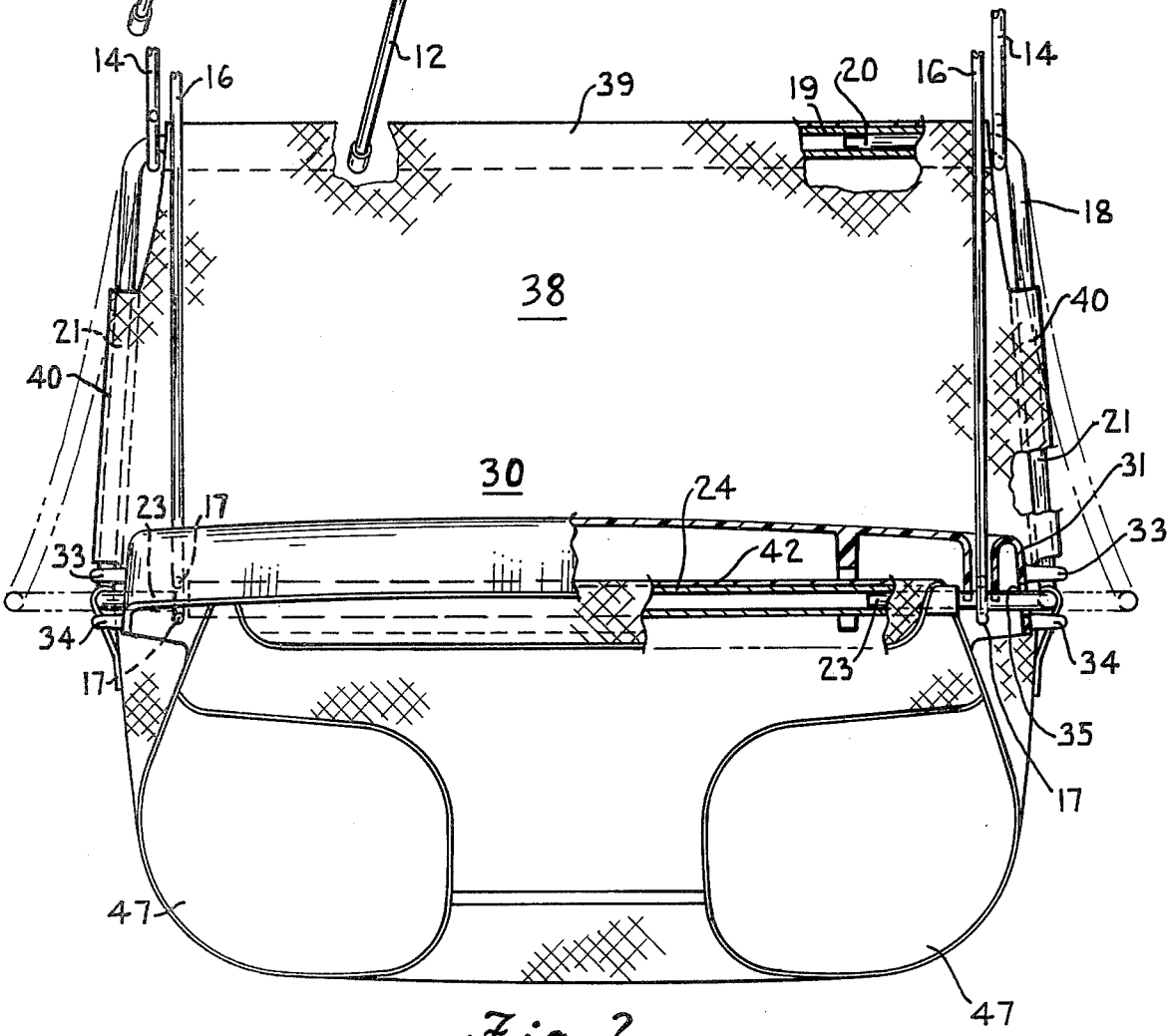
Fig. 2.

SEAT FOR BABY SWING

BACKGROUND OF THE INVENTION

1. Field of the Invention

This invention relates to a seat construction for a baby swing.

2. Brief Description of the Prior Art

It has heretofore been proposed to provide both rigid and flexible fabric seats for baby swings but these had various shortcomings.

The rigid seats and the flexible fabric seats did not have suitable trays and the assembly of the flexible fabric seats was difficult, particularly if the structure was shipped knocked down to reduce the package size for shipping and for assembly by the purchaser.

SUMMARY OF THE INVENTION

In accordance with the invention a seat construction forbaby swings is provided having a flexible fabric seat and back with leg holes at the seat for the baby, the seat and back being supported by a frame preferably with an upper tubular portion and side portions engaged therein and bent to provide horizontal top tube engaging portions, downwardly and forwardly extending side portions and horizontal inturned ends for engagement in a lower frame tube forwardly of the flexible seat, a molded synthetic plastic tray being provided with which the wire frame and lower frame tube are engaged, the front supports for the seat construction extending downwardly through the tray and in pivotal engagement with the inturned ends of the wire frame. The wire frame at the top has spaced locations for engagement by the rear seat supports.

It is the principal object of the invention to provide a seat construction for baby swings and the like which is strong, is easy to assemble and to fold for storage, has a long life, is free from problems in use and protects the baby.

It is a further object of the invention to provide a seat construction for baby swings having an improved tray with the tray receptacle being particularly suited for retaining articles therein in different swing positions.

It is a further object of the invention to provide a seat construction for baby swings having an improved tray to protect the baby against injury or self injury.

Other objects and advantageous features of the invention will be apparent from the description and claims.

BRIEF DESCRIPTION OF THE DRAWINGS

The nature and characteristic features of the invention will be more readily understood from the following description, taken in connection with the accompanying drawings forming part hereof, in which:

FIG. 1 is a view in perspective of a baby swing having the seat construction of the invention employed therein;

FIG. 1A is a side elevational view of the structure shown in FIG. 1 but collapsed for storage;

FIG. 2 is a front elevational view of the seat construction of the present invention, parts being broken away to show the details of construction;

Figure 4:
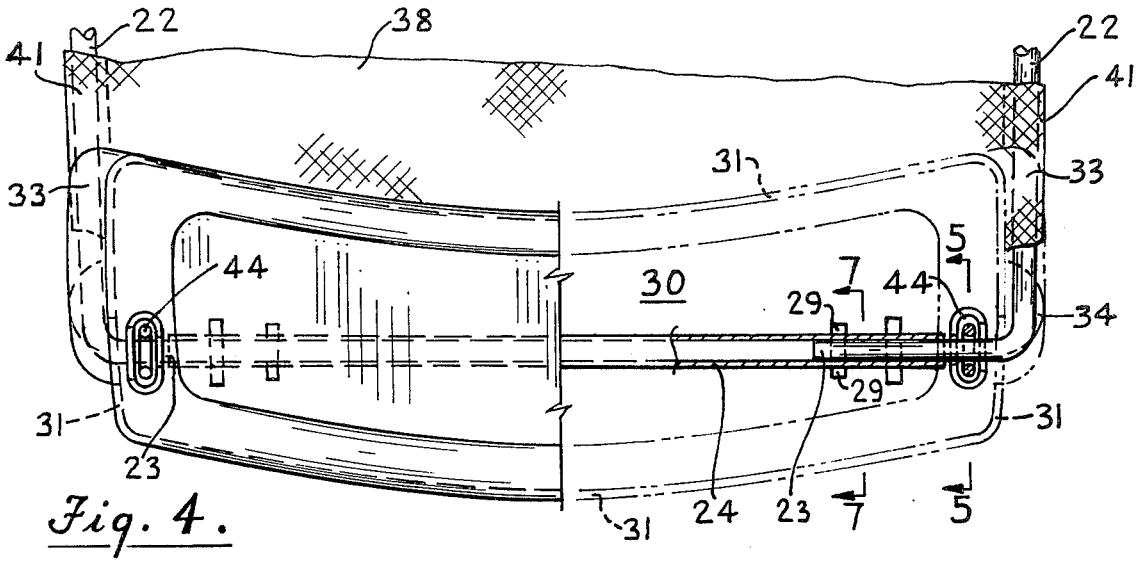
FIG. 4 is a top plan view of the portion of the seat construction shown in FIG. 3.
Figure 5:
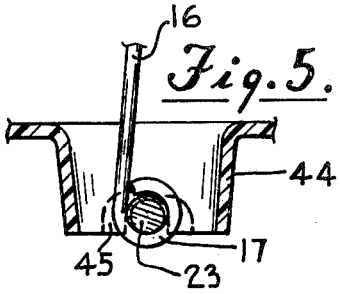
FIG. 5 is a vertical sectional view taken approximately on the line 5—5 of FIG. 4.
Figure 3:
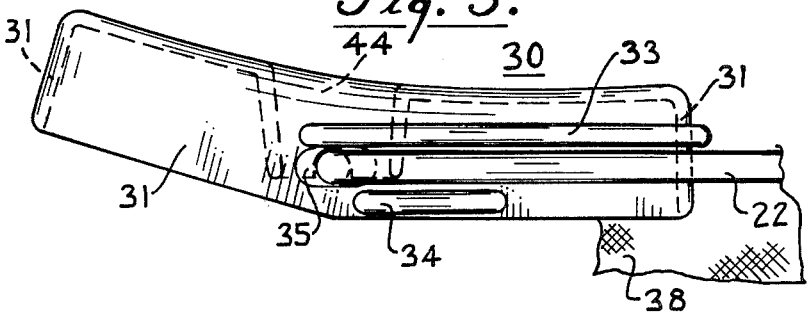
FIG. 3 is a side elevational view of the tray and a portion of the seat construction shown in FIG. 2.
Figure 7:
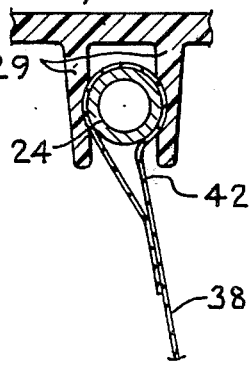
FIG. 7 is an enlarged vertical sectional view taken approximately on the line 7—7 of FIG. 4.
Figure 8:
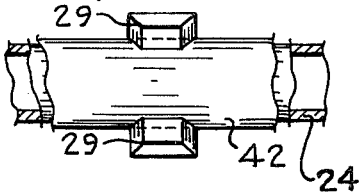
FIG. 8 is a bottom plan view of the fingers shown in FIG. 7.
Figure 6:
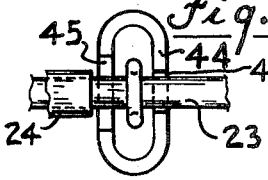
FIG. 6 is a bottom plan view of the structure shown in FIG. 5.
Figure 9:
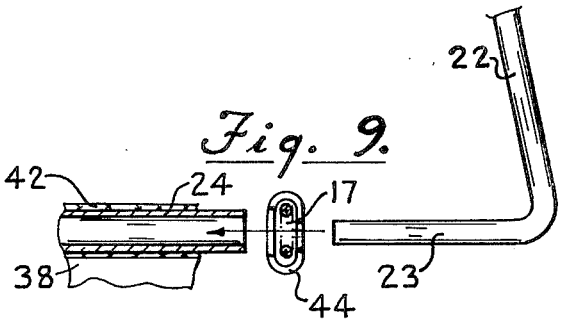
FIG. 9 is a fragmentary view illustrating the insertion and removal of the frame and frame tube.

It should, of course, be understood that the description and drawings herein are illustrative merely, and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings, a baby swing is shown at 10, having an upper swing frame 11 supported by diverging legs 12 with braces **12*a* pivotally connected at one end to a leg 12 and detachably connected at the other end to a leg 12 on the same side. The frame 11 may have a spring operated driving motor (not shown) mounted therein with an oscillatory seat support 13** such as is shown in the U.S. Pat. No. 2,807,309 to Saint. Any other suitable support could be employed from which the seat is supported in a pendant relation.

The oscillatory seat support 13 has rear seat support rods 14 with lower hook ends 15 and front seat support rods 16 carried thereby with lower loop or eye ends 17.

The seat construction in accordance with the invention includes a frame 18 preferably having an upper tubular section 19 into which inturned end sections 20 of wire extend, the end sections 20 having integral parallel upper side sections 21 extending therefrom in the same plane but at an angle to provide for gripping engagement and retention in the tubular section 19 by a slight springing action when fully assembled, integral parallel lower side sections 22 extending forwardly from the upper side section 22 at an angle, with inturned end sections 23 facing toward each other. The end sections 23 extend into a lower frame tube 24 into which they are insertable for assembly and are retained by the resilience of the frame 18.

A tray 30 is provided, molded preferably of strong but not brittle synthetic plastic material such as polystyrene or polypropylene. The tray 30 preferably has an outer downwardly extending peripheral rim 31 for stiffening and a central recessed portion 32 for the retention of toys and the like and on the bottom face thereof has spaced pairs of molded fingers 29 for resilient engagement with the frame tube 24.

The tray 30, along the rim 31 at each side, has an upper rib 33 extending rearwardly below the top face of the tray 30 and partially around the rear of the rim 31, and a spaced parallel lower rib 34 for the reception and retention of the side frame sections 22, openings 35 through the rim 31 being provided forthe insertion of the end sections 23. The ribs 33 and 34 by their engagement with frame sections 22 prevent relative tilting movement of the tray 30 and frame 18.

The frame 18 and frame tube 24 carry a flexible fabric seat 38 with an upper tubular portion 39 mounted on the upper tubular section 19, upper side tubular portions 40 mounted on the upper side sections 21, lower side tubular portions 41 mounted on the lower side sections 22 and a front tubular portion 42 carried on the frame tube 24.

The tray 30, inwardly of the rim 31, on each side has a downwardly extending elongated socket 44 through which the lower end of the front seat support rods 16 extend with the loop ends 17 in pivotal engagement with inturned end sections 23.

The socket 44 has aligned openings 45 for insertion therethrough of the end sections 23.

The flexible fabric seat 38 has leg openings 47 for the legs of the baby.

If desired the frame 18 can be made of a single piece of wire but the use of the upper tubular frame section 19 permits of a more compact disassembled frame for shipping.

The fabric seat 38, at the junctions of the end sections 20 and the side sections 21, is relieved to permit the pivotal connection of the hook ends 15 of the rear seat support rods 14 to the end sections 20 on each side.

Upon assembly by the user, if the frame 18 and seat 38 have been shipped disassembled, the upper tubular portion 39 can have the upper tubular frame section 19 inserted therein. An end section 20 on one side is then inserted through the lower tubular side portion 41 and the upper tubular side portion 40 with the tubular portion 40 on the upper side frame section 21 and the lower tubular side portion 41 on the lower side frame section 22. The end section 20 is then inserted into the upper tubular frame section 19.

The other end section 20 is similarly inserted through the tubular portions 41 and 40 on the other side and into the other end of the upper tubular frame section 19. The angle between the end section 20 and the upper frame section 21 is preferably such that when in assembled condition the upper part of the seat 38 applies a light tension on the upper frame sections 20 to hold the ends 20 in the upper tubular section 19 in gripped engagement. The lower frame tube 24 is inserted through the front tubular portion 42 and positioned in engagement with the fingers 29 by which it is resiliently held in place.

One of the end frame sections 23 can then be inserted through the opening 35, through the openings 45 in the socket 44 and through the eye end 17 of the front support rod 16 aligned therein, and into one end of the frame tube 24. The lower side section 22 is nested between the ribs 33 and 34.

The other end section 23 can be sprung apart and inserted from the opposite side through the opening 35, in engagement through the eye end 17, into the opposite end of the frame tube 24, and with the lower side section disposed between the upper and lower ribs 33 and 34 in the manner previously described.

The seat can be folded upwardly upon disconnection of the rear support rods 14 for storage.

It will thus be seen that a seat for a baby swing has been provided with which the objects of the invention are attained.

I claim:

1. A seat for a baby swing comprising a tray having an upper face and downwardly extending front and side edge portions, a flexible frame member having opposite side sections with upper and lower angularly disposed portions, said upper portions of said frame member being connected at the top and said lower portion having lower inturned end sections disposed below the top of the tray, a hollow tubular frame member having ends, inwardly of and contiguous to the sides of the tray, for the reception of said inturned end sections, a seat member of flexible sheet material having leg openings and having tubular portions in engagement with said flexible frame member and with said tubular frame member, said tray having downwardly extending portions in gripping engagement with said second frame member and side edge portions through which opposite side sections of said frame extend, front seat supports extending through said tray inwardly with respect to said side edge portions of the tray and in pivotal engagement with said inturned end sections.

2. A seat as defined in claim 1 in which said flexible frame member is in simultaneous engagement with said front seat supports, said side portions of said tray, and said second frame member.

3. A seat as defined in claim 1 in which said flexible frame member has a horizontal top section to which said upper and lower side sections are connected, said seat member has tubular portions in engagementwith said top section and said side sections, said seat member has a tubular portion in engagement with said second frame member, front seat supports are provided with which said flexible frame member is in engagement, and rear seat supports are provided in detachable pivotal engagement with said top section of said frame.

4. A seat as defined in claim 3 in which said flexible frame member has its inturned end sections retractible from their engagement with said second frame member, said front seat supports, said tray and said seat member.

5. A seat as defined in claim 1 in which rear seat supports are provided, and said flexible frame member has spaced portions for detachable pivotal engagement by said rear seat supports.

6. A seat as defined in claim 1 in which said flexible frame member is unitary.

* * * * *